US007004240B1

(12) United States Patent
Kroliczek et al.

(10) Patent No.: US 7,004,240 B1
(45) Date of Patent: Feb. 28, 2006

(54) HEAT TRANSPORT SYSTEM

(75) Inventors: Edward J. Kroliczek, Davidsonville, MD (US); James Seokgeun Yun, Silver Spring, MD (US)

(73) Assignee: Swales & Associates, Inc., Beltsville, MD (US)

( * ) Notice: Subject to any disclaimer, the term of this patent is extended or adjusted under 35 U.S.C. 154(b) by 269 days.

(21) Appl. No.: 10/602,022

(22) Filed: Jun. 24, 2003

Related U.S. Application Data

(60) Provisional application No. 60/391,006, filed on Jun. 24, 2002.

(51) Int. Cl.
*F28D 15/00* (2006.01)

(52) U.S. Cl. ..... 165/104.26; 165/41; 165/42; 165/104.21; 165/104.33; 165/104.11; 165/104.19

(58) Field of Classification Search ..... 165/41, 165/42, 104.21, 104.26, 104.33, 104.11, 104.19; 244/163, 158 R
See application file for complete search history.

(56) References Cited

U.S. PATENT DOCUMENTS

| | | | | |
|---|---|---|---|---|
| 4,862,708 A | | 9/1989 | Basiulis | |
| 5,103,897 A | * | 4/1992 | Cullimore et al. | 165/274 |
| 5,303,768 A | * | 4/1994 | Alario et al. | 165/104.26 |
| 5,771,967 A | | 6/1998 | Hyman | |
| 5,816,313 A | | 10/1998 | Baker | |
| 5,842,513 A | * | 12/1998 | Maciaszek et al. | 165/104.26 |
| 5,899,265 A | * | 5/1999 | Schneider et al. | 165/104.33 |
| 5,944,092 A | * | 8/1999 | Van Oost | 165/104.26 |
| 5,950,710 A | | 9/1999 | Liu | |
| 5,966,957 A | * | 10/1999 | Malhammar et al. | 62/259.2 |
| 6,058,711 A | * | 5/2000 | Maciaszek et al. | 62/3.2 |
| 6,330,907 B1 | * | 12/2001 | Ogushi et al. | 165/104.26 |
| 6,381,135 B1 | * | 4/2002 | Prasher et al. | 361/700 |
| 6,382,309 B1 | | 5/2002 | Kroliczek et al. | |
| 6,450,132 B1 | * | 9/2002 | Yao et al. | 122/366 |
| 6,615,912 B1 | * | 9/2003 | Garner | 165/104.26 |
| 6,810,946 B1 | | 11/2004 | Hoang | |
| 6,889,754 B1 | | 5/2005 | Kroliczek et al. | |
| 2002/0007937 A1 | * | 1/2002 | Kroliczek et al. | 165/104.26 |
| 2003/0051857 A1 | * | 3/2003 | Cluzet et al. | 165/41 |

(Continued)

FOREIGN PATENT DOCUMENTS

| | | |
|---|---|---|
| EP | 0 210 337 | 2/1987 |

(Continued)

OTHER PUBLICATIONS

"A high power spacecraft thermal management system," J. Ku, et al., AIAA-1988-2702, Thermophysics, Plasmadynamics and Lasers Conference, San Antonio, TX, Jun. 27-29, 1988, 12 pages.

(Continued)

*Primary Examiner*—Henry Bennett
*Assistant Examiner*—Nihir Patel
(74) *Attorney, Agent, or Firm*—Fish & Richardson P.C.

(57) ABSTRACT

A system includes a heat transfer system and a priming system coupled to the heat transfer system. The heat transfer system includes a main evaporator having a core, a primary wick, and a secondary wick, and a condenser coupled to the main evaporator by a liquid line and a vapor line. A heat transfer system loop is defined by the main evaporator, the condenser, the liquid line, and the vapor line. The priming system is configured to convert fluid into a liquid capable of wetting the primary wick of the main evaporator. The priming system includes a priming evaporator coupled to the vapor line, and a reservoir in fluid communication with the priming evaporator and coupled to the secondary wick of the main evaporator by a secondary fluid line.

44 Claims, 10 Drawing Sheets

U.S. PATENT DOCUMENTS

| | | | |
|---|---|---|---|
| 2004/0182550 | A1 | 9/2004 | Kroliczek et al. |
| 2004/0206479 | A1 | 10/2004 | Kroliczek et al. |

FOREIGN PATENT DOCUMENTS

| | | |
|---|---|---|
| EP | 0 987 509 | 3/2000 |
| JP | 2000-555777 | 2/2000 |
| RU | 2 098 733 | 3/1995 |
| RU | 1 467 354 | 1/1997 |
| WO | WO 02/10661 | 7/2003 |

OTHER PUBLICATIONS

"A methodology for enveloping reliable start-up of LHPS," Jane Baumann et al., AIAA-2000-2285, AIAA Thermophysics Conference, 34th, Denver, Co, Jun. 19-22, 2000, 9 pages.
"Across-Gimbal and Miniaturized Cryogenic Loop Heat Pipes," Bugby, D. et al., CP654, Space Technology and Applications International Forum-STAIF 2003, edited by M.S. El-Genk, American Institute of Physics, 2003, pp. 218-226.
"Advanced Capillary Pumped Loop (A-CPL) Project Summary," Hoang, Contract No.: NAS5-98103, Mar. 1994, pp. 1-37.
"Advanced Components for Cryogenic Integration,"Bugby, D. et al., Cryocoolers 12, edited by R.G. Ross, Jr., Kluwer Academic/Plenum Publishers, 2003, pp. 693-708.
"Advanced Components for Cryogenic Integration," D. Bugby et al, Proceedings of teh 12th International Crycooler Conference, held Jun. 18-20, 2002, in Cambridge MA., 15 pages.
"Advanced Components and Techniques for Cryogenic Integration,"D. Bugby et al., Environmental systems-Intermational conference; 31st, Society of Automotive Engineers New York, 2001-01-2378, Orlando, FL 2001; Jul (200107), 9 pages.
"Advanced Components and Techniques for Cryogenic Integration," D. Bugby et al., presented at 2002 Spacecraft Thermal Control Symposium by Swales Aerospace, El Segundo, CA, Mar. 2002, 14 pages.
"An Improved High Power Hybrid Capillary Pumped Loop," J. Ku et al., paper submitted to SAE 19th Intersociety Conference on Environment Systems, SAE 891566, San Diego, CA, Jul. 24027, 1989, 10 pages.
"Design and Experimental Results of the HPCPL," Van Oost et al., ESTEC CPL-96 Workshop, Noordwijk, Netherlands, 1996, 29 pages.
"Design and Test of a Proof-of-Concept Advanced Capillary Pumped Loop,"Triem T. Hoang, Society of Automotive Engineers, presented at the 27th Environmental systems International conference, New York, 1997, Paper 972326, 6 pages.
"Design and Test Results of Multi-Evaporator Loop Heat Pipe," Yun, Seokgeun, et al., SAE Paper No. 1999-01-2051, 29th International Conference on Environmental Systems, Jul. 1999, 7 pages.
"Design and Testing of a 40 W Free-Piston Stirling Cycle Cooling Unit," Berchowitz, D. M. et al., 20th International Conference of Refrigeration, IIR/IIF, Sydney, 1999, 7 pages.
"Design and Testing of a High Power Spacecraft Thermal Management System," McCabe, Jr., Michael E. et al., National Aeronautics and Space Administration (NASA), NASA Technical Memorandum 4051, Scientific and Technical Information Division, 1988, 107 pages.
"Development and Testing of a Gimbal Thermal Transport System," D. Bugby et al., Proceedings of the 11th International Cryocooler Conference, held Jun. 20-22, 2000, in Keystone, Colorado, 11 pages.
"Development of a Cryogenic Loop Heat Pipe (CLHP) for Passive Optical Bench Cooling Applications," James Yun, et al., 32nd International Conference on Environmental Systems (ICES-2002), Society of Automotive Engineers Paper No. 2002-01-2507, San Antonio, Texas, 2002, 9 pages.
"Development of an Advanced Capillary Pumped Loop," Triem T. Hoang et al., Society of Automotive Engineers, presented at the 27th Environmental systems International conference, New York, 1997, Paper 972325, 6 pages.
"Development of Advenced Cyrogenic Integration Solutions," D. Bugby et al., presented at the 10th International Cryocoolers Conference on May 26-28, 1998 in Monterey, CA and published in "Cryocoolers 10," by Ron Ross, Jr., Kluwer Academic/Plenum Publishers, NY 1999, 17 pages.
"Energy Efficient Freezer Installation Using Natural Working Fluids and a Free Piston Stirling Cooler," Welty, Stephen C. et al., VI Congreso Iberoamericano De Aire Acondicionado Y Refreigeracion, CIAR 2001, Trabajo No. 96, pp. 199-208, Aug. 15-17, 2001.
"Experimental Investigation of a Stirling Cycle Cooled Domestic Refrigerator,"Oguz, Emre et al., 9th Proceedings of the International Refrigeration and Air Conditioning Conference at Purdue, 2002; 9th; vol. 2, pp. 777-784.
"Free-Piston Rankine Compression and Stirling Cycle Macines for Domestic Refrigeration,"Berchowitz, David M., Presented at the Greenpeace Ozon Safe Conference, Washington, DC, Oct. 18-19, 1993.
"Hydrogen Loop Pipe Design & Test Results," O'Connell et al., presented at 2002 Spacecraft Thermal Control Symposium by TTH Reserach, El Segundo, CA, Mar. 2002, 14 pages.
"Maximized Performance of Stirling Cycle Refrigerators," Berchowitz, D.M., Natural working fluids '98 IIR-Gustav Lorentzen Conference: Oslo, Norway, Jun. 2-5, 1998, Fluides actifs naturels conference IIF-Gustav Lorentzen, Journal: Science et technique du froid, 1998 (4) 422-429.
"Measurement and application of performance characteristics of a Free Piston Stirling Cooler," Janssen, Martien et al., 9th International Refrigeration and Air Conditioning Conference, Jul. 16-19, 2002, 8 pages.
"Methods of Increase of the Evaporators Reliability for Loop Heat Pipes and Capillary Pumped Loops,"Kotlyarov, E. Yu et al., 24th International Conference on Environmental Systems, Jun. 20-23, 1994, 941578, 7 pages.
"Multiple Evaporator Loop Heat Pipe,"James Yun, et al., Society of Automotive Engineers, 2000-01-2410, 30th International Conference on Environmental Systems, Jul. 10-13, 2000, 10 pages.
"Operational Characteristics of Loop Heat Pipes," Jentung Ku, 29th International Conference on Environmental Systems, Denver, CO, Jul. 12-15, 1999, 17 pages.
"Operational Characteristics of Stirling Machinery," Kwon, Yong-Rak et al., International Congress of Refrigeration, Aug. 17-22, 2003, 8 pages.
"Recent Advences in Capillary Pumped Loop Technology," J. Ku, 1997 National Heat Transfer Conference, Baltimore, MD, Aug. 10-12, 1997, AIAA 97-3870, 22 pages.
"Recent Advences in Stirling Cycle Refrigeration," Berchowitz, D. M. et al., 1995, 19th International Conference of Refrigeration, The Hague, The Netherlands, 8 pages.

"Testing of a Caprillary Pumped Loop with Multiple parallel starter pumps," J. Ku et al, SAE Paper No. 972329, 1997.
"Test Results of Relable and Very High Capillary Multi-Evaporators/Condenser Loop," Van Oost, Stéphane et al., 25th Internatioal Conference on Environmental Systems, Jul. 10-13, 1995, 6 pages.
"The Hybrid Capillary Pumped Loop,"J. Ku et al., paper submitted to SAE 18th Ingersociety Conference on Environmental Systems, SAE 881083, San Francisco, CA, Jul. 11-13, 1988, 11 pages.
"The Proof-of-feasibility of Multiple Evaporator Loop Heat Pipes," W.B. Bienert et al., Proceedings of the Eighth Annual Spacecraft Thermal Control Workshop, 1997, 8 pages.
"The Application of Stirling Cooler to Refrigeration,"Kim, Seon-Young et al., IECEC-97-Intersociety Energy Conversion Engineering Conference, 1997, Congerence 32, vol. 2, pp. 1023-1026.

* cited by examiner

HEAT TRANSPORT SYSTEM

CROSS REFERENCE TO RELATED APPLICATIONS

This application claims priority to U.S. Application No. 60/391,006, filed Jun. 24, 2002 and U.S. application Ser. No. 09/896,561, filed Jun. 29, 2001, which claimed priority to U.S. Application No. 60/215,588, filed Jun. 30, 2000. These applications are herein incorporated by reference in their entirety.

TECHNICAL FIELD

This description relates to a system for heat transfer.

BACKGROUND

Heat transport systems are used to transport heat from one location (the heat source) to another location (the heat sink). Heat transport systems can be used in terrestrial or extra-terrestrial applications. For example, heat transport systems may be integrated by satellite equipment that operates within zero or low-gravity environments. As another example, heat transport systems can be used in electronic equipment, which often requires cooling during operation.

Loop Heat Pipes (LHPs) and Capillary Pumped Loops (CPLs) are passive two-phase heat transport systems. Each includes an evaporator thermally coupled to the heat source, a condenser thermally coupled to the heat sink, fluid that flows between the evaporator and the condenser, and a fluid reservoir for expansion of the fluid. The fluid within the heat transport system can be referred to as the working fluid. The evaporator includes a primary wick and a core that includes a fluid flow passage. Heat acquired by the evaporator is transported to and discharged by the condenser. These systems utilize capillary pressure developed in a fine-pored wick within the evaporator to promote circulation of working fluid from the evaporator to the condenser and back to the evaporator. The primary distinguishing characteristic between an LHP and a CPL is the location of the loop's reservoir, which is used to store excess fluid displaced from the loop during operation. In general, the reservoir of a CPL is located remotely from the evaporator, while the reservoir of an LHP is co-located with the evaporator.

SUMMARY

In one general aspect, a system includes a heat transfer system and a priming system coupled to the heat transfer system. The heat transfer system includes a main evaporator having a core, a primary wick, and a secondary wick, and a condenser coupled to the main evaporator by a liquid line and a vapor line. A heat transfer system loop is defined by the main evaporator, the condenser, the liquid line, and the vapor line. The priming system is configured to convert fluid into a liquid capable of wetting the primary wick of the main evaporator. The priming system includes a priming evaporator coupled to the vapor line, and a reservoir in fluid communication with the priming evaporator and coupled to the secondary wick of the main evaporator by a secondary fluid line.

Implementations may include one or more of the following features. For example, the reservoir may be cold biased relative to an operating temperature of the heat transfer system. The reservoir may be mounted to a heat sink thermally connected to the condenser.

The secondary fluid line may insulate the liquid line from parasitic heat input. For example, the secondary fluid line may be coaxial with and surround the liquid line.

The priming system may be configured to reduce the temperature of the heat transfer system. The main evaporator may include a three-port evaporator. The reservoir may be coupled to the secondary wick of the main evaporator through a secondary condenser and a liquid line coupled to the core of the main evaporator.

The priming system may be configured to convert fluid that has a critical temperature above an operating temperature of the heat transfer system into a liquid. The operating temperature of the heat transfer system may be a cryogenic temperature or a sub-ambient temperature.

The heat transfer system may be used to cool an apparatus operating in an extra-terrestrial environment. The heat transfer system may be used to cool an apparatus operating in a terrestrial environment. The heat transfer system may be used to cool an electronic apparatus or an apparatus in a medical application. The heat transfer system may be used to cool one or more of a vending machine, a computer, a component in a transportation device, a display for a computer, and an infrared sensor.

The heat transfer system may include another reservoir operating at a temperature higher than the temperature of operation for the reservoir of the priming system to reduce a fill pressure of the system. The priming evaporator may include a core, a primary wick surround the core, and a secondary wick within the core. The main evaporator may include a bayonet tube extending through the core to guide fluid into the core.

In another general aspect, a method of transporting heat includes priming a heat transfer system that includes a main evaporator, a vapor line, a condenser, and a liquid line connected in a loop and reducing heat conditions within the heat transfer system. Priming the heat transfer system includes wetting a primary wick of a priming system evaporator, applying power to the priming system evaporator, converting fluid received from the priming system evaporator into a liquid, and wetting the main evaporator of the heat transfer system with the liquid through the liquid line. Reducing heat conditions within the heat transfer system includes at least one of sweeping vapor bubbles within the main evaporator into a reservoir in fluid communication with the priming evaporator or reducing parasitic heat gains on the liquid line.

Implementations may include one or more of the following features. For example, application of power to the priming evaporator may enhance circulation of fluid within the heat transfer system. Enhancing circulation of fluid within the heat transfer system may include enhancing circulation of fluid from the main evaporator, through the vapor line, through the condenser, through the liquid line, and returning into the main evaporator.

The method may further include reducing power to the priming system evaporator once the priming system evaporator is wetted. The method may include reducing power to the priming system evaporator once the priming system evaporator reaches a temperature below a critical temperature of the fluid.

The method may also include cold biasing the reservoir relative to a temperature of the heat transfer system. Cold biasing the reservoir may include mounting the reservoir to a heat sink that is in fluid communication with the condenser.

Wetting the primary wick of the priming system evaporator may include cold-biasing the reservoir to a temperature below the critical temperature of the fluid. Wetting the primary wick of the priming system evaporator may include pumping liquid formed within the reservoir into the priming system evaporator using capillary pressure.

The method may also include coupling the reservoir to a secondary fluid line in communication with a core of the main evaporator. Sweeping vapor bubbles within the main evaporator into the reservoir may include sweeping bubbles through a secondary wick of the main evaporator, through a secondary fluid line, through a secondary condenser, and into the reservoir. Reducing parasitic heat gains on the liquid line may include forming the secondary fluid line coaxially around the liquid line such that the secondary fluid line insulates the liquid line from parasitic heat gains. Reducing parasitic heat gains on the liquid line may include sweeping vapor bubbles formed within the secondary fluid line due to the parasitic heat gains into the secondary condenser, where the vapor bubbles are cooled and pushed into the reservoir.

The method may also include insulating the liquid line from parasitic heat gains. The method may further include operating the heat transfer system to transport heat from a heat source. The method may include operating the heat transfer system at a cryogenic temperature or a sub-ambient temperature.

The method may include using the heat transfer system to transport heat from an apparatus operating in an extra-terrestrial environment or from an apparatus operating in a terrestrial environment. The method may include using the heat transfer system to transport heat from an electronic apparatus, from an apparatus within a medical device, from an infrared sensor, from a vending machine, from a computer, from a component in a transportation device, or from a display device.

Aspects of the system and method can include one or more of the following advantages. For example, system and method permit startup from a supercritical state, which is a state in which the temperature of the system is above the critical temperature of the working fluid. The system and method is designed to enable cooling of the reservoir and the evaporator to temperatures below the critical temperature of the working fluid up and to enable the evaporator to be primed with liquid.

Other features will be apparent from the description, the drawings, and the claims.

DESCRIPTION OF DRAWINGS

Like reference symbols in the various drawings indicate like elements.

DETAILED DESCRIPTION

As discussed above, in a loop heat pipe (LHP), the reservoir is co-located with the evaporator, thus, the reservoir is thermally and hydraulically connected with the reservoir through a heat-pipe-like conduit. In this way, liquid from the reservoir can be pumped to the evaporator, thus ensuring that the primary wick of the evaporator is sufficiently wetted or "primed" during start-up. Additionally, the design of the LHP also reduces depletion of liquid from the primary wick of the evaporator during steady-state or transient operation of the evaporator within a heat transport system. Moreover, vapor and/or bubbles of non-condensable gas (NCG bubbles) vent from a core of the evaporator through the heat-pipe-like conduit into the reservoir.

Conventional LHPs require that liquid be present in the reservoir prior to start-up, that is, application of power to the evaporator of the LHP. However, if the working fluid in the LHP is in a supercritical state prior to start-up of the LHP, liquid will not be present in the reservoir prior to start-up. A supercritical state is a state in which a temperature of the LHP is above the critical temperature of the working fluid. The critical temperature of a fluid is the highest temperature at which the fluid can exhibit a liquid-vapor equilibrium. For example, the LHP may be in a supercritical state if the working fluid is a cryogenic fluid, that is, a fluid having a boiling point below −150° C., or if the working fluid is a sub-ambient fluid, that is, a fluid having a boiling point below the temperature of the environment in which the LHP is operating.

Conventional LHPs also require that liquid returning to the evaporator is subcooled, that is, cooled to a temperature that is lower than the boiling point of the working fluid. Such a constraint makes it impractical to operate LHPs at a sub-ambient temperature. For example, if the working fluid is a cryogenic fluid, the LHP is likely operating in an environment having a temperature greater than the boiling point of the fluid.

Figure 1:
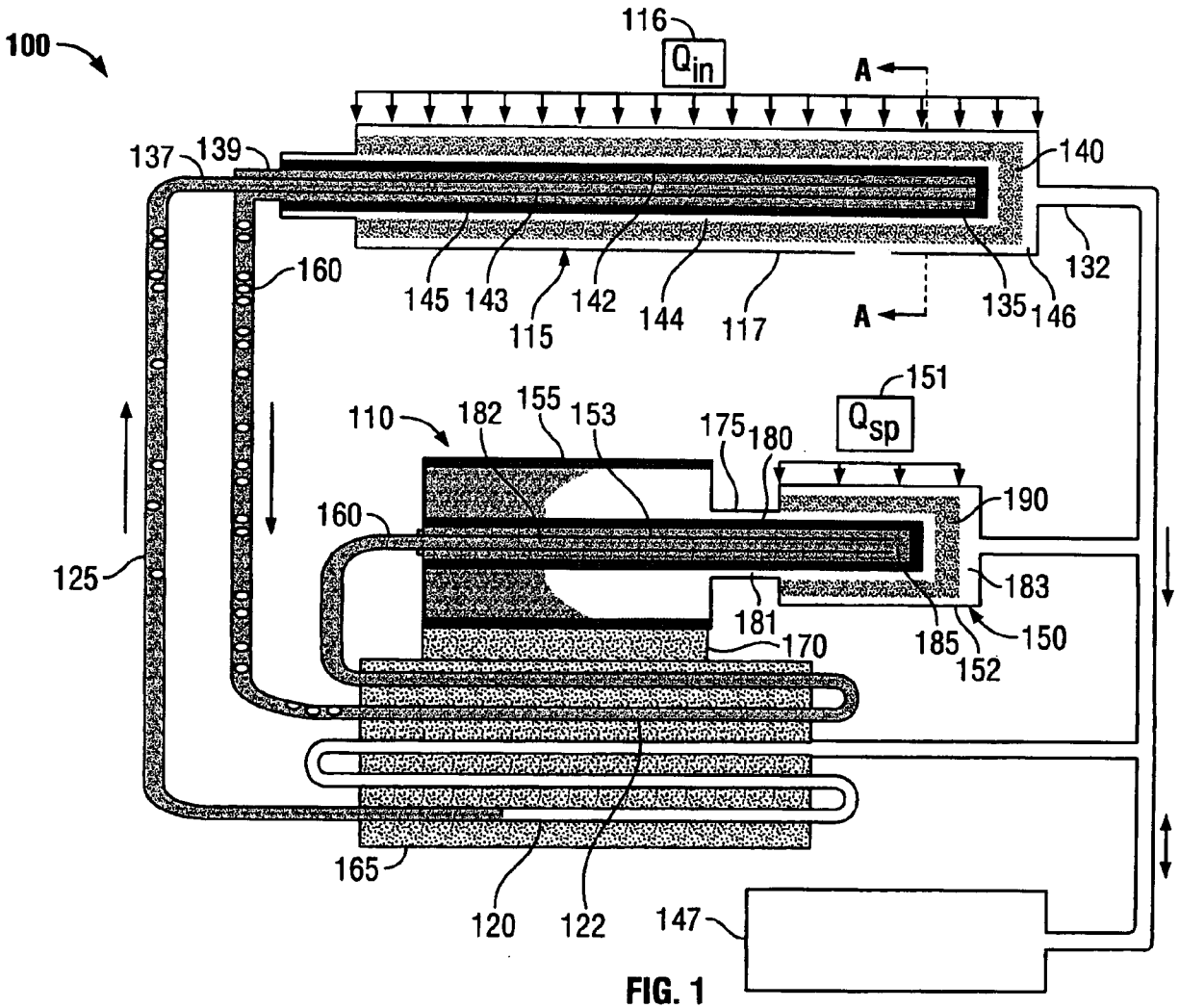
FIG. 1 is a schematic diagram of a heat transport system.

Referring to FIG. 1, a heat transport system 100 is designed to overcome limitations of conventional LHPs. The heat transport system 100 includes a heat transfer system 105 and a priming system 110. The priming system 110 is configured to convert fluid within the heat transfer system 105 into a liquid, thus priming the heat transfer system 105. As used in this description, the term "fluid" is a generic term that refers to a substance that is both a liquid and a vapor in saturated equilibrium.

The heat transfer system 105 includes a main evaporator 115, and a condenser 120 coupled to the main evaporator 115 by a liquid line 125 and a vapor line 130. The condenser 120 is in thermal communication with a heat sink 165, and the main evaporator 115 is in thermal communication with a heat source $Q_{in}$ 116. The system 105 may also include a hot reservoir 147 coupled to the vapor line 130 for additional pressure containment, as needed. In particular, the hot reservoir 147 increases the volume of the system 100. If the working fluid is at a temperature above its critical temperature, that is, the highest temperature at which the working fluid can exhibit liquid-vapor equilibrium, its pressure is proportional to the mass in the system 100 (the charge) and inversely proportional to the volume of the system. Increasing the volume with the hot reservoir 147 lowers the fill pressure.

The main evaporator 115 includes a container 117 that houses a primary wick 140 within which a core 135 is defined. The main evaporator 115 includes a bayonet tube 142 and a secondary wick 145 within the core 135. The bayonet tube 142, the primary wick 140, and the secondary wick 145 define a liquid passage 143, a first vapor passage 144, and a second vapor passage 146. The secondary wick 145 provides phase control, that is, liquid/vapor separation in the core 135, as discussed in U.S. application Ser. No. 09/896,561, filed Jun. 29, 2001, which is incorporated herein by reference in its entirety. As shown, the main evaporator 115 has three ports, a liquid inlet 137 into the liquid passage 143, a vapor outlet 132 into the vapor line 130 from the second vapor passage 146, and a fluid outlet 139 from the liquid passage 143 (and possibly the first vapor passage 144, as discussed below). Further details on the structure of a three-port evaporator are discussed below with respect to FIGS. 5A and 5B.

The priming system 110 includes a secondary or priming evaporator 150 coupled to the vapor line 130 and a reservoir 155 co-located with the secondary evaporator 150. The reservoir 155 is coupled to the core 135 of the main evaporator 115 by a secondary fluid line 160 and a secondary condenser 122. The secondary fluid line 160 couples to the fluid outlet 139 of the main evaporator 115. The priming system 110 also includes a controlled heat source $Q_{sp}$ 151 in thermal communication with the secondary evaporator 150.

The secondary evaporator 150 includes a container 152 that houses a primary wick 190 within which a core 185 is defined. The secondary evaporator 150 includes a bayonet tube 153 and a secondary wick 180 that extend from the core 185, through a conduit 175, and into the reservoir 155. The secondary wick 180 provides a capillary link between the reservoir 155 and the secondary evaporator 150. The bayonet tube 153, the primary wick 190, and the secondary wick 180 define a liquid passage 182 coupled to the fluid line 160, a first vapor passage 181 coupled to the reservoir 155, and a second vapor passage 183 coupled to the vapor line 130. The reservoir 155 is thermally and hydraulically coupled to the core 185 of the secondary evaporator 150 through the liquid passage 182, the secondary wick 180, and the first vapor passage 181. Vapor and/or NCG bubbles from the core 185 of the secondary evaporator 150 are swept through the first vapor passage 181 to the reservoir 155 and condensable liquid is returned to the secondary evaporator 150 through the secondary wick 180 from the reservoir 155. The primary wick 190 hydraulically links liquid within the core 185 to the heat source Qsp 151, permitting liquid at an outer surface of the primary wick 190 to evaporate and form vapor within the second vapor passage 183 when heat is applied to the secondary evaporator 150.

The reservoir 155 is cold-biased, and thus, it is cooled by a cooling source that will allow it to operate, if unheated, at a temperature that is lower than the temperature at which the heat transfer system 105 operates. In one implementation, the reservoir 155 and the secondary condenser 122 are in thermal communication with the heat sink 165 that is thermally coupled to the condenser 120. For example, the reservoir 155 can be mounted to the heat sink 165 using a shunt 170, which may be made of aluminum or any heat conductive material. In this way, the temperature of the reservoir 155 tracks the temperature of the condenser 120.

Figure 2:
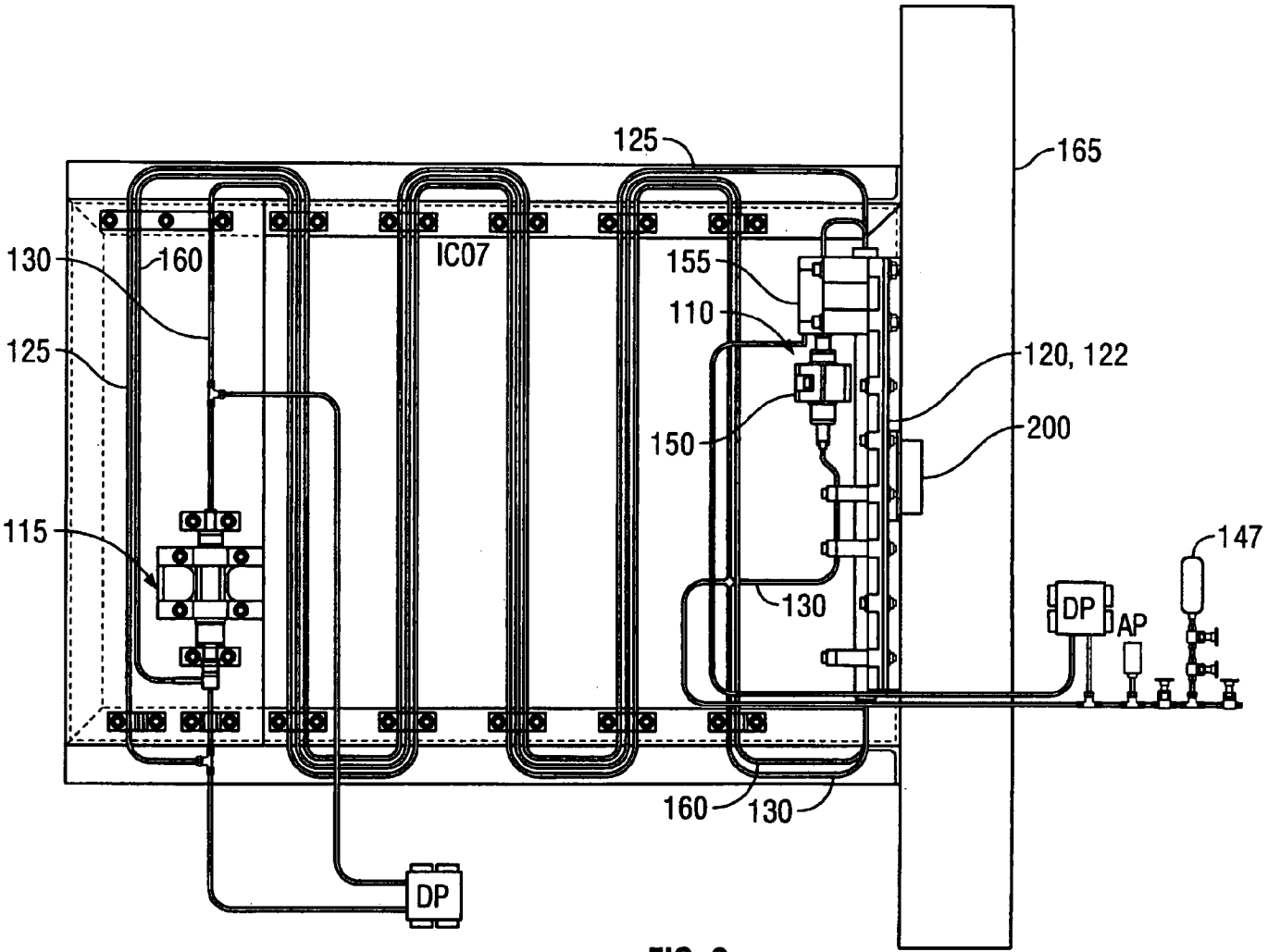
FIG. 2 is a diagram of an implementation of the heat transport system schematically shown by FIG. 1.

FIG. 2 shows an example of an implementation of the heat transport system 100. In this implementation, the condensers 120 and 122 are mounted to a cryocooler 200, which acts as a refrigerator, transferring heat from the condensers 120, 122 to the heat sink 165. Additionally, in the implementation of FIG. 2, the lines 125, 130, 160 are wound to reduce space requirements for the heat transport system 100.

Though not shown in FIGS. 1 and 2, elements such as, for example, the reservoir 155 and the main evaporator 115, may be equipped with temperature sensors that can be used for diagnostic or testing purposes.

Figure 3:
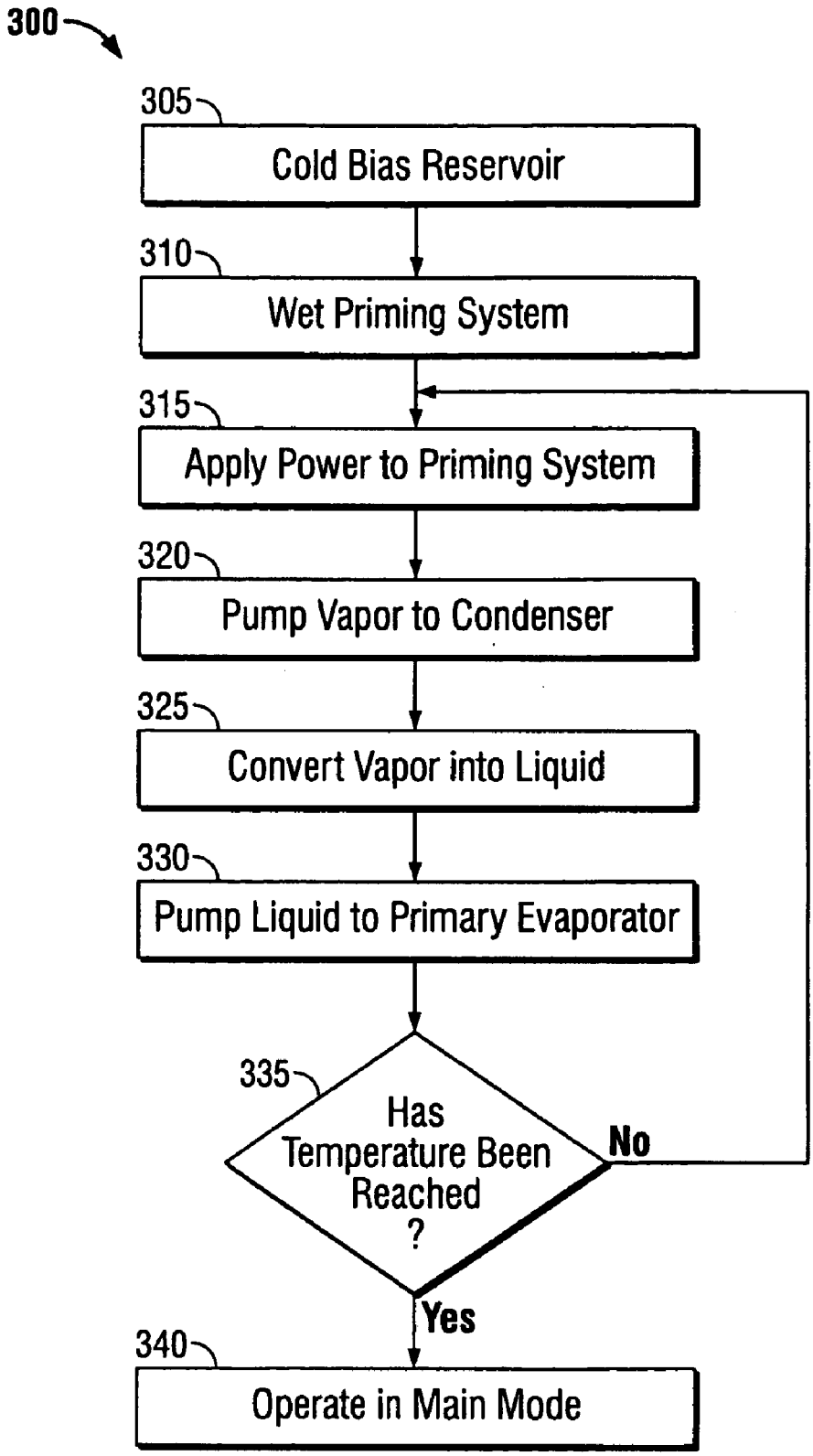
FIG. 3 is a flow chart of a procedure for transporting heat using a heat transport system.

Referring also to FIG. 3, the system 100 performs a procedure 300 for transporting heat from the heat source $Q_{in}$ 116 and for ensuring that the main evaporator 115 is wetted with liquid prior to startup. The procedure 300 is particularly useful when the heat transfer system 105 is at a supercritical state. Prior to initiation of the procedure 300, the system 100 is filled with a working fluid at a particular pressure, referred to as a "fill pressure."

Initially, the reservoir 155 is cold-biased by, for example, mounting the reservoir 155 to the heat sink 165 (step 305). The reservoir 155 may be cold-biased to a temperature below the critical temperature of the working fluid, which, as discussed, is the highest temperature at which the working fluid can exhibit liquid-vapor equilibrium. For example, if the fluid is ethane, which has a critical temperature of 33° C., the reservoir 155 is cooled to below 33° C. As the temperature of the reservoir 155 drops below the critical temperature of the working fluid, the reservoir 155 partially fills with a liquid condensate formed by the working fluid. The formation of liquid within the reservoir 155 wets the secondary wick 180 and the primary wick 190 of the secondary evaporator 150 (step 310).

Meanwhile, power is applied to the priming system 110 by applying heat from the heat source $Q_{sp}$ 151 to the secondary evaporator 150 (step 315) to enhance or initiate circulation of fluid within the heat transfer system 105. Vapor output by the secondary evaporator 150 is pumped through the vapor line 130 and through the condenser 120 (step 320) due to capillary pressure at the interface between the primary wick 190 and the second vapor passage 183. As vapor reaches the condenser 120, it is converted to liquid (step 325). The liquid formed in the condenser 120 is pumped to the main evaporator 1, 15 of the heat transfer system 105 (step 330). When the main evaporator 115 is at a higher temperature than the critical temperature of the fluid, the liquid entering the main evaporator 115 evaporates and cools the main evaporator 115. This process (steps 315–330) continues, causing the main evaporator 115 to reach a set point temperature (step 335), at which point the main evaporator is able to retain liquid and be wetted and to operate as a capillary pump. In one implementation, the set point temperature is the temperature to which the reservoir 155 has been cooled. In another implementation, the set point temperature is a temperature below the critical temperature of the working fluid. In a further implementation, the set point temperature is a temperature above the temperature to which the reservoir 155 has been cooled.

If the set point temperature has been reached (step 335), the system 100 operates in a main mode (step 340) in which heat from the heat source $Q_{in}$ 116 that is applied to the main evaporator 115 is transferred by the heat transfer system 105. Specifically, in the main mode, the main evaporator 115 develops capillary pumping to promote circulation of the working fluid through the heat transfer system 105. Also, in the main mode, the set point temperature of the reservoir 155 is reduced. The rate at which the heat transfer system 105 cools down during the main mode depends on the cold biasing of the reservoir 155 because the temperature of the main evaporator 115 closely follows the temperature of the reservoir 155. Additionally, though not required, a heater can be used to further control or regulate the temperature of the reservoir 155 during the main mode. Furthermore, in main mode, the power applied to the secondary evaporator 150 by the heat source $Q_{sp}$ 151 is reduced, thus bringing the heat transfer system 105 down to a normal operating temperature for the fluid. For example, in the main mode, the heat load from the heat source $Q_{sp}$ 151 to the secondary evaporator 150 is kept at a value equal to or in excess of heat conditions, as defined below. In one implementation, the heat load from the heat source $Q_{sp}$ is kept to about 5 to 10% of the heat load applied to the main evaporator 115 from the heat source $Q_{in}$ 116.

In this particular implementation, the main mode is triggered by the determination that the set point temperature has been reached (step 335). In other implementations, the main mode may begin at other times or due to other triggers. For example, the main mode may begin after the priming system is wet (step 310) or after the reservoir has been cold biased (step 305).

At any time during operation, the heat transfer system 105 can experience heat conditions such as those resulting from heat conduction across the primary wick 140 and parasitic heat applied to the liquid line 125. Both conditions cause formation of vapor on the liquid side of the evaporator. Specifically, heat conduction across the primary wick 140 can cause liquid in the core 135 to form vapor bubbles, which, if left within the core 135, would grow and block off liquid supply to the primary wick 140, thus causing the main evaporator 115 to fail. Parasitic heat input into the liquid line 125 (referred to as "parasitic heat gains") can cause liquid within the liquid line 125 to form vapor.

To reduce the adverse impact of heat conditions discussed above, the priming system 110 operates at a power level $Q_{sp}$ 151 greater than or equal to the sum of the head conduction and the parasitic heat gains. As mentioned above, for example, the priming system can operate at 5–10% of the power to the heat transfer system 105. In particular, fluid that includes a combination of vapor bubbles and liquid is swept out of the core 135 for discharge into the secondary fluid line 160 leading to the secondary condenser 122. In particular, vapor that forms within the core 135 travels around the bayonet tube 143 directly into the fluid outlet port 139. Vapor that forms within the first vapor passage 144 makes it way into the fluid outlet port 139 by either traveling through the secondary wick 145 (if the pore size of the secondary wick 145 is large enough to accommodate vapor bubbles) or through an opening at an end of the secondary wick 145 near the outlet port 139 that provides a clear passage from the first vapor passages 144 to the outlet port 139. The secondary condenser 122 condenses the bubbles in the fluid and pushes the fluid to the reservoir 155 for reintroduction into the heat transfer system 105.

Figure 8A:
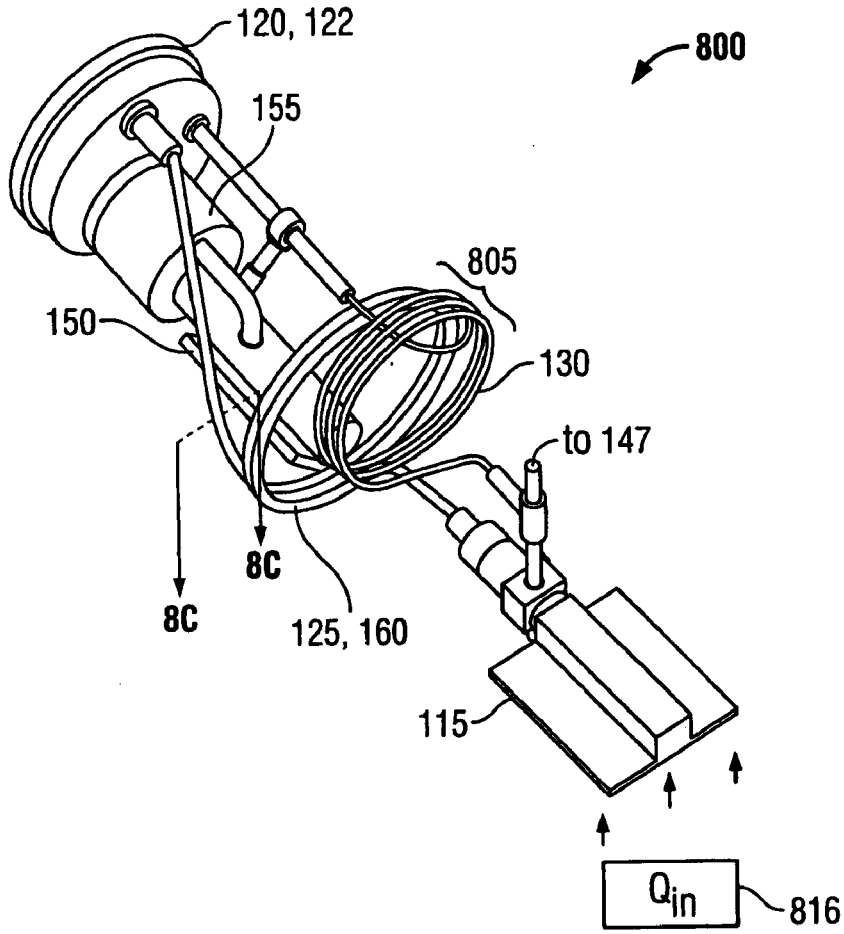
FIGS. 8A, 8B, 9A, and 9B are perspective views of applications using a heat transport system.
Figure 8B:
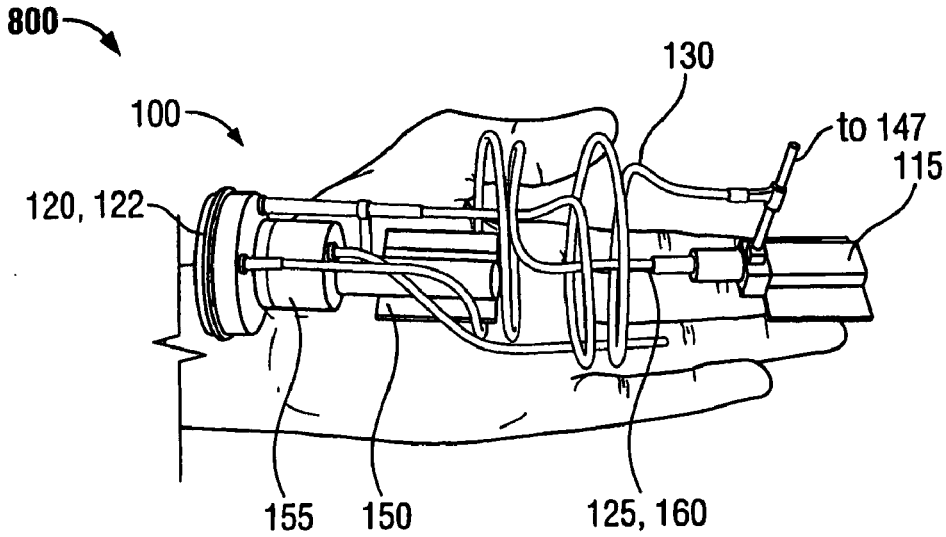
Figure 8C:
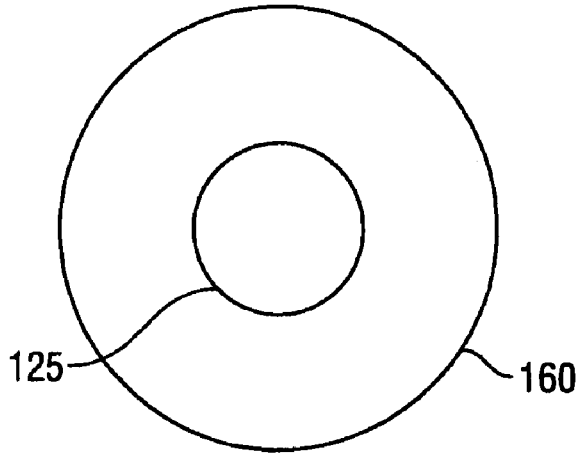
FIG. 8C is a cross-sectional view of a fluid line taken along 8C—8C of FIG. 8A.
Figure 8D:
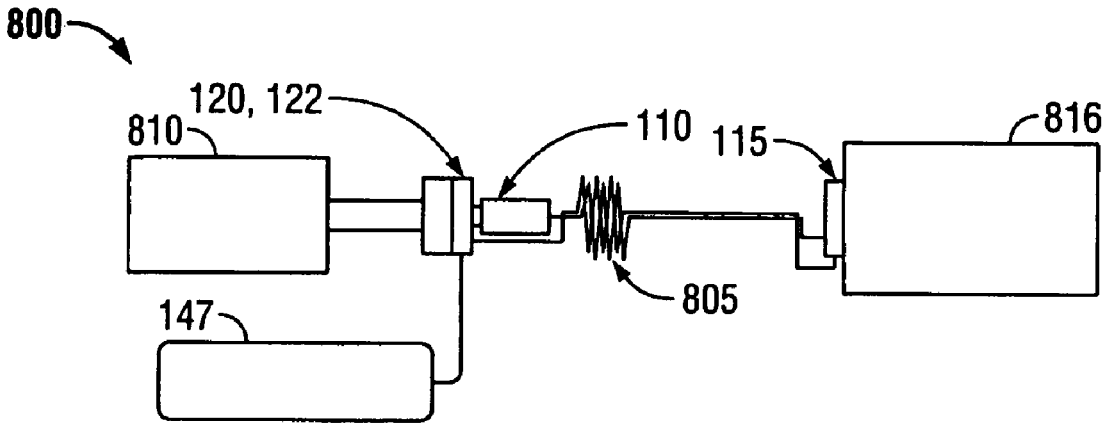
FIGS. 8D and 9C are schematic diagrams of the implementations of the heat transport systems of FIGS. 8A and 9A, respectively.

Similarly, to reduce parasitic heat input to the liquid line 125, the secondary fluid line 160 and the liquid line 125 can form a coaxial configuration and the secondary fluid line 160 surrounds and insulates the liquid line 125 from surrounding heat. This implementation is discussed further below with reference to FIGS. 8A and 8B. As a consequence of this configuration, it is possible for the surrounding heat to cause vapor bubbles to form in the secondary fluid line 160, instead of in the liquid line 125. As discussed, by virtue of capillary action affected at the secondary wick 145, fluid flows from the main evaporator 115 to the secondary condenser 122. This fluid flow, and the relatively low temperature of the secondary condenser 122, causes a sweeping of the vapor bubbles within the secondary fluid line 160 through the condenser 122, where they are condensed into liquid and pumped into the reservoir 155.

Figure 4:
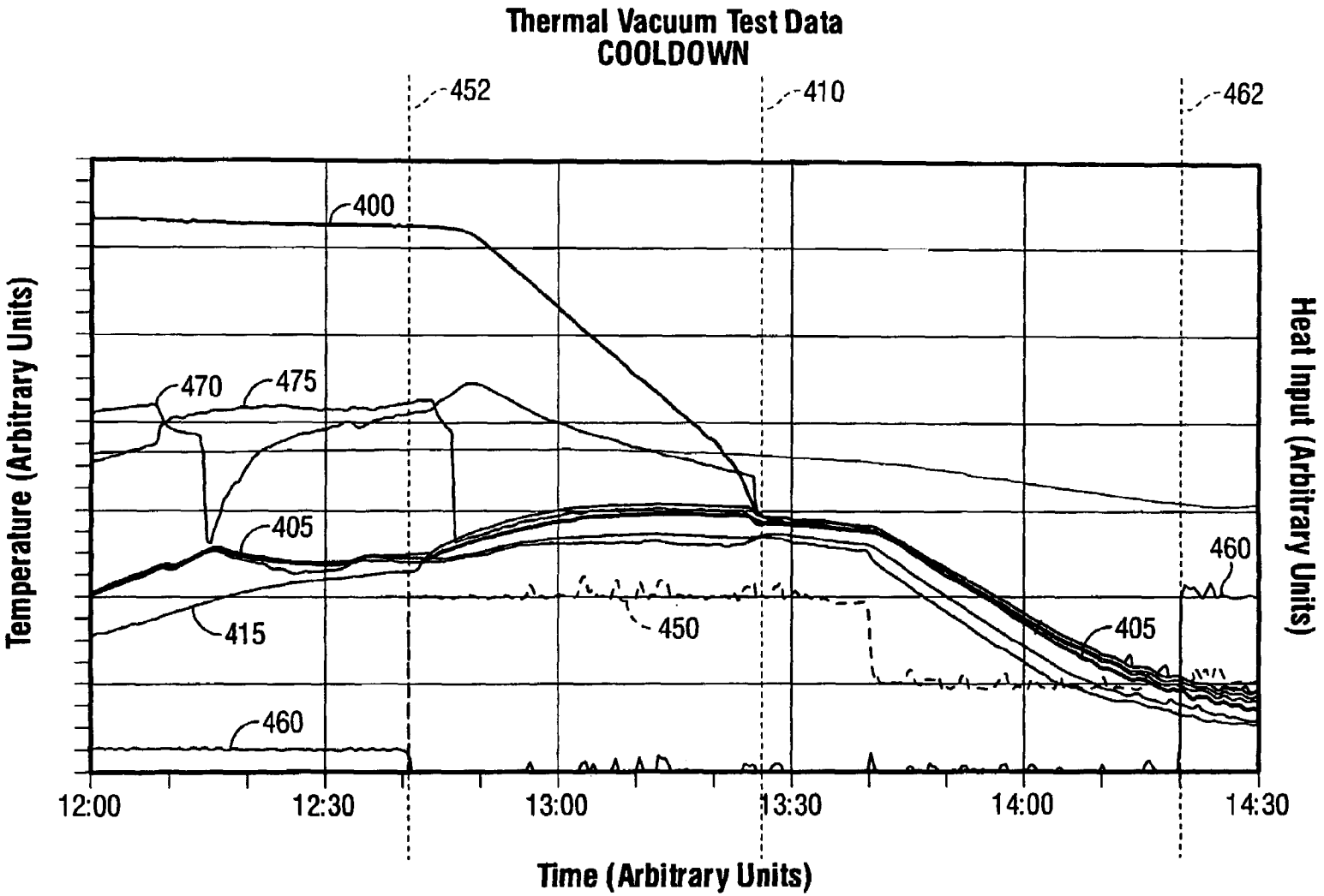
FIG. 4 is a graph showing temperature profiles of various components of the heat transport system during the process flow of FIG. 3.

As shown in FIG. 4, data from a test run is shown. In this implementation, prior to startup of the main evaporator 115 at temperature 410, a temperature 400 of the main evaporator 115 is significantly higher than a temperature 405 of the reservoir 155, which has been cold-biased to the set point temperature (step 305). As the priming system 110 is wetted (step 310), power $Q_{sp}$ 450 is applied to the secondary evaporator 150 (step 315) at a time 452, causing liquid to be pumped to the main evaporator 115 (step 330), the temperature 400 of the main evaporator 115 drops until it reaches the temperature 405 of the reservoir 155 at time 410. Power $Q_{in}$ 460 is applied to the main evaporator 115 at a time 462, when the system 100 is operating in LHP mode (step 340). As shown, power input $Q_{in}$ 460 to the main evaporator 115 is held relatively low while the main evaporator 115 is cooling down. Also shown are the temperatures 470 and 475, respectively, of the secondary fluid line 160 and the liquid line 125. After time 410, temperatures 470 and 475 track the temperature 400 of the main evaporator 115. Moreover, a temperature 415 of the secondary evaporator 150 follows closely with the temperature 405 of the reservoir 155 because of the thermal communication between the secondary evaporator 150 and the reservoir 155.

As mentioned, in one implementation, ethane may be used as the fluid in the heat transfer system 105. Although the critical temperature of ethane is 33° C., for the reasons generally described above, the system 100 can start up from a supercritical state in which the system 100 is at a temperature of 70° C. As power $Q_{sp}$ is applied to the secondary evaporator 150, the temperatures of the condenser 120 and the reservoir 155 drop rapidly (between times 452 and 410). A trim heater can be used to control the temperature of the reservoir 155 and thus the condenser 120 to −10° C. To startup the main evaporator 115 from the supercritical temperature of 70° C., a heat load or power input $Q_{sp}$ of 10 W is applied to the secondary evaporator 150. Once the main evaporator 115 is primed, the power input from the heat source $Q_{sp}$ 151 to the secondary evaporator 150 and the power applied to and through the trim heater both may be reduced to bring the temperature of the system 100 down to a nominal operating temperature of about −50° C. For instance, during the main mode, if a power input $Q_{in}$ of 40 W is applied to the main evaporator 115, the power input $Q_{sp}$ to the secondary evaporator 150 can be reduced to approximately 3 W while operating at −45° C. to mitigate the 3 W lost through heat conditions (as discussed above). As another example, the main evaporator 115 can operate with power input $Q_{in}$ from about 10 W to about 40 W with 5 W applied to the secondary evaporator 150 and with the temperature 405 of the reservoir 155 at approximately −45° C.

Figure 5A:
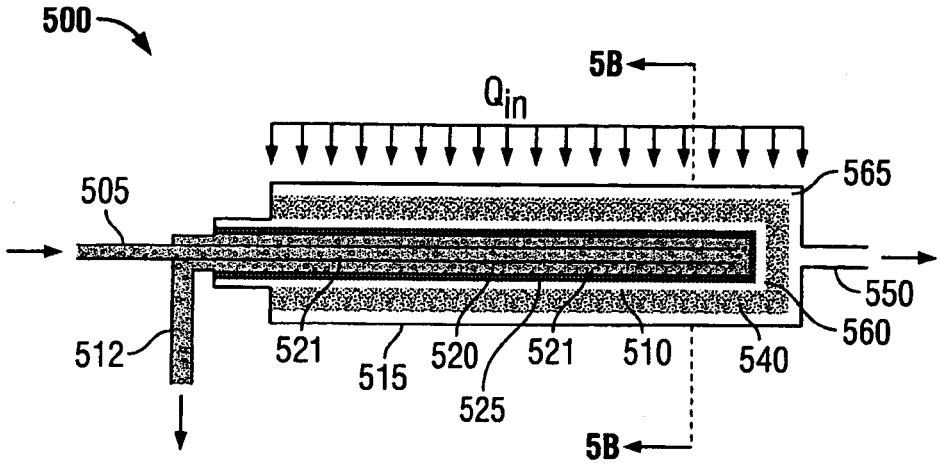
FIG. 5A is a diagram of a three-port main evaporator shown within the heat transport system of FIG. 1.
Figure 5B:
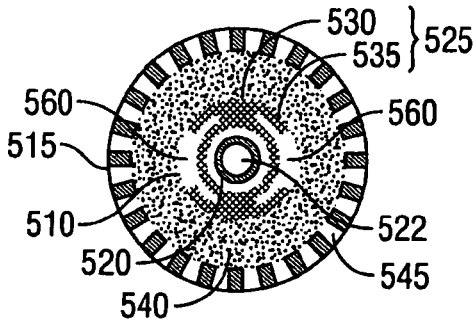
FIG. 5B is a cross-sectional view of the main evaporator taken along 5B—5B of FIG. 5A.

Referring to FIGS. 5A and 5B, in one implementation, the main evaporator 115 is designed as a three-port evaporator 500 (which is the design shown in FIG. 1). Generally, in the three-port evaporator 500, liquid flows into a liquid inlet 505 into a core 510, defined by a primary wick 540, and fluid from the core 510 flows from a fluid outlet 512 to a cold-biased reservoir (such as reservoir 155). The fluid and the core 510 are housed within a container 515 made of, for example, aluminum. In particular, fluid flowing from the liquid inlet 505 into the core 510 flows through a bayonet tube 520, into a liquid passage 521 that flows through and around the bayonet tube 520. Fluid can flow through a secondary wick 525 (such as secondary wick 145 of evaporator 115) made of a wick material 530 and an annular artery 535. The wick material 530 separates the annular artery 535 from a first vapor passage 560. As power from the heat source $Q_{in}$ 116 is applied to the evaporator 500, liquid from the core 510 enters a primary wick 540 and evaporates, forming vapor that is free to flow along a second vapor passage 565 that includes one or more vapor grooves 545 and out a vapor outlet 550 into the vapor line 130. Vapor bubbles that form within first vapor passage 560 of the core 510 are swept out of the core 510 through the first vapor passage 560 and into the fluid outlet 512. As discussed above, vapor bubbles within the first vapor passage 560 may pass through the secondary wick 525 if the pore size of the secondary wick 525 is large enough to accommodate the vapor bubbles. Alternatively, or additionally, vapor bubbles within the first vapor passage 560 may pass through an opening of the secondary wick 525 formed at any suitable location along the secondary wick 525 to enter the liquid passage 521 or the fluid outlet 512.

Figure 6:
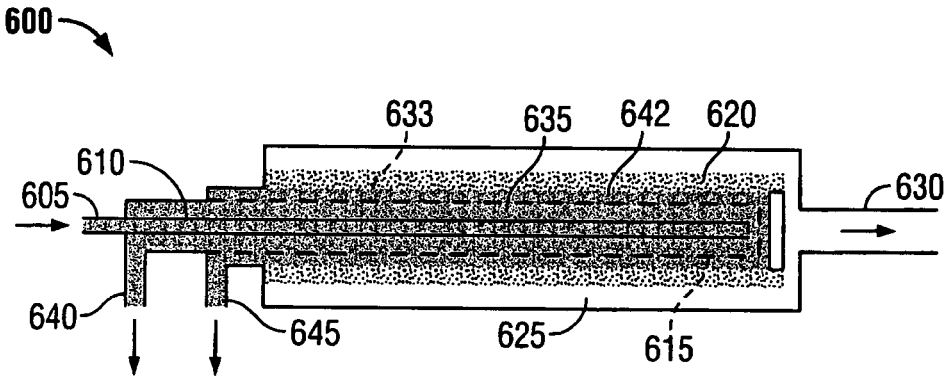
FIG. 6 is a diagram of a four-port main evaporator that can be integrated into a heat transport system illustrated by FIG. 1.

Referring to FIG. 6, in another implementation, the main evaporator 115 is designed as a four-port evaporator 600, which is a design described in U.S. application Ser. No. 09/896,561, filed Jun. 29, 2001. Briefly, and with emphasis on aspects that differ from the three-port evaporator configuration, liquid flows into the evaporator 600 through a fluid inlet 605, through a bayonet 610, and into a core 615. The liquid within the core 615 enters a primary wick 620 and evaporates, forming vapor that is free to flow along vapor grooves 625 and out a vapor outlet 630 into the vapor line 130. A secondary wick 633 within the core 615 separates liquid within the core from vapor or bubbles in the core (that are produced when liquid in the core 615 heats). The liquid carrying bubbles formed within a first fluid passage 635 inside the secondary wick 633 flows out of a fluid outlet 640 and the vapor or bubbles formed within a vapor passage 642 positioned between the secondary wick 633 and the primary wick 620 flow out of a vapor outlet 645.

Figure 7:
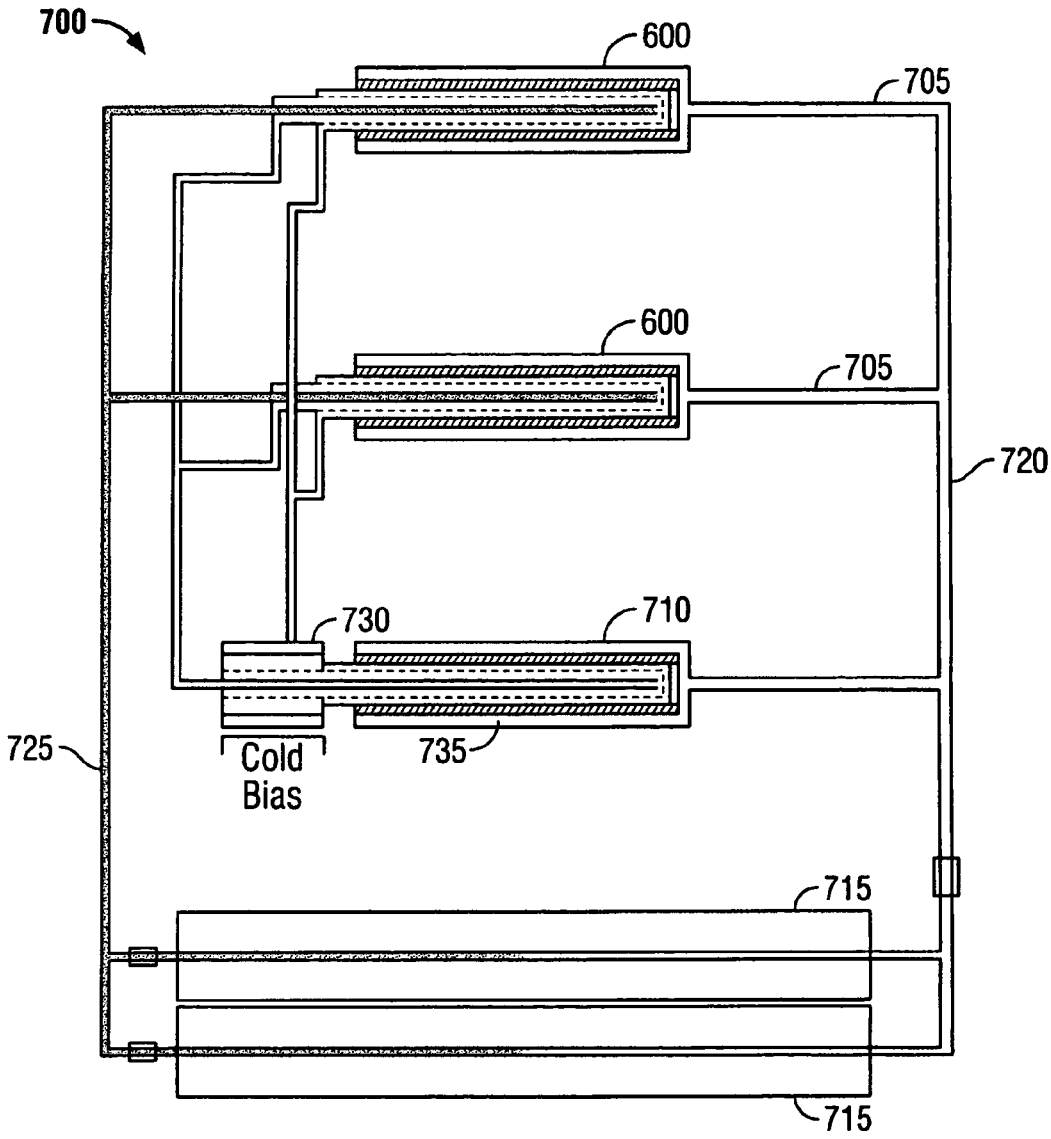
FIG. 7 is a schematic diagram of an implementation of a heat transport system.

Referring also to FIG. 7, a heat transport system 700 is shown in which the main evaporator is a four-port evaporator 600. The system 700 includes one or more heat transfer systems 705 and a priming system 710 configured to convert fluid within the heat transfer systems 705 into a liquid to prime the heat transfer systems 705. The four-port evaporators 600 are coupled to one or more condensers 715 by a vapor line 720 and a fluid line 725. The priming system 710 includes a cold-biased reservoir 730 hydraulically and thermally connected to a priming evaporator 735.

Design considerations of the heat transport system 100 include startup of the main evaporator 115 from a supercritical state, management of parasitic heat leaks, heat conduction across the primary wick 140, cold biasing of the cold reservoir 155, and pressure containment at ambient temperatures that are greater than the critical temperature of the working fluid within the heat transfer system 105. To accommodate these design considerations, the body or container (such as container 515) of the evaporator 115 or 150 can be made of extruded 6063 aluminum and the primary wicks 140 and/or 190 can be made of a fine-pored wick. In one implementation, the outer diameter of the evaporator 115 or 150 is approximately 0.625 inches and the length of the container is approximately 6 inches. The reservoir 155 may be cold-biased to an end panel of the radiator 165 using the aluminum shunt 170. Furthermore, a heater (such as a kapton heater) can be attached at a side of the reservoir 155.

In one implementation, the vapor line 130 is made with smooth walled stainless steel tubing having an outer diameter (OD) of 3/16" and the liquid line 125 and the secondary fluid line 160 are made of smooth walled stainless steel tubing having an OD of 1/8". The lines 125, 130, 160 may be bent in a serpentine route and plated with gold to minimize parasitic heat gains. Additionally, the lines 125, 130, 160 may be enclosed in a stainless steel box with heaters to simulate a particular environment during testing. The stainless steel box can be insulated with multi-layer insulation (MLI) to minimize heat leaks through panels of the heat sink 165.

In one implementation, the condenser 122 and the secondary fluid line 160 are made of tubing having an OD of 0.25 inches. The tubing is bonded to the panels of the heat sink 165 using, for example, epoxy. Each panel of the heat sink 165 is an 8×19 inch direct condensation, aluminum radiator that uses a 1/16-inch thick face sheet. Kapton heaters can be attached to the panels of the heat sink 165, near the condenser 120 to prevent inadvertent freezing of the working fluid. During operation, temperature sensors such as thermocouples can be used to monitor temperatures throughout the system 100.

The heat transport system 100 may be implemented in any circumstances where the critical temperature of the working fluid of the heat transfer system 105 is below the ambient temperature at which the system 100 is operating. The heat transport system 100 can be used to cool down components that require cryogenic cooling.

Referring to FIGS. 8A–8D, the heat transport system 100 may be implemented in a miniaturized cryogenic system 800. In the miniaturized system 800, the lines 125, 130, 160 are made of flexible material to permit coil configurations 805, which save space. The miniaturized system 800 can operate at −238° C. using neon fluid. Power input $Q_{in}$ 116 is approximately 0.3 to 2.5 W. The miniaturized system 800 thermally couples a cryogenic component (or heat source that requires cryogenic cooling) 816 to a cryogenic cooling source such as a cryocooler 810 coupled to cool the condensers 120, 122.

The miniaturized system 800 reduces mass, increases flexibility, and provides thermal switching capability when compared with traditional thermally-switchable, vibration-isolated systems. Traditional thermally-switchable, vibration-isolated systems require two flexible conductive links (FCLs), a cryogenic thermal switch (CTSW), and a conduction bar (CB) that form a loop to transfer heat from the cryogenic component to the cryogenic cooling source. In the miniaturized system 800, thermal performance is enhanced because the number of mechanical interfaces is reduced. Heat conditions at mechanical interfaces account for a large percentage of heat gains within traditional thermally-switchable, vibration-isolated systems. The CB and two FCLs are replaced with the low-mass, flexible, thin-walled tubing used for the coil configurations 805 of the miniaturized system 800.

Moreover, the miniaturized system 800 can function of a wide range of heat transport distances, which permits a configuration in which the cooling source (such as the cryocooler 810) is located remotely from the cryogenic component 816. The coil configurations 805 have a low mass and low surface area, thus reducing parasitic heat gains through the lines 125 and 160. The configuration of the cooling source 810 within miniaturized system 800 facilitates integration and packaging of the system 800 and reduces vibrations on the cooling source 810, which becomes particularly important in infrared sensor applications. In one implementation, the miniaturized system 800 was tested using neon, operating at 25–40 K.

Figure 9A:
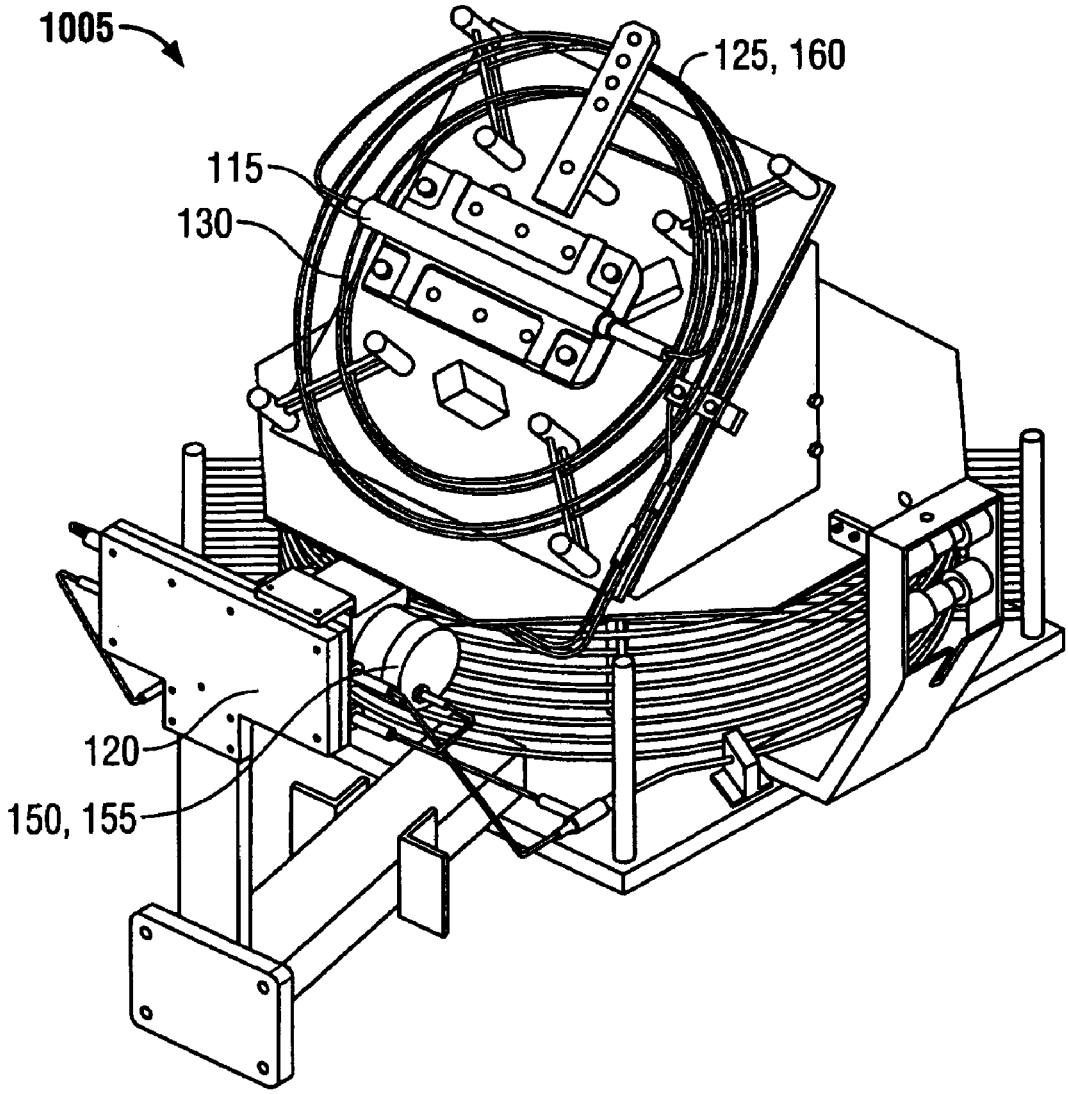
Figure 9B:
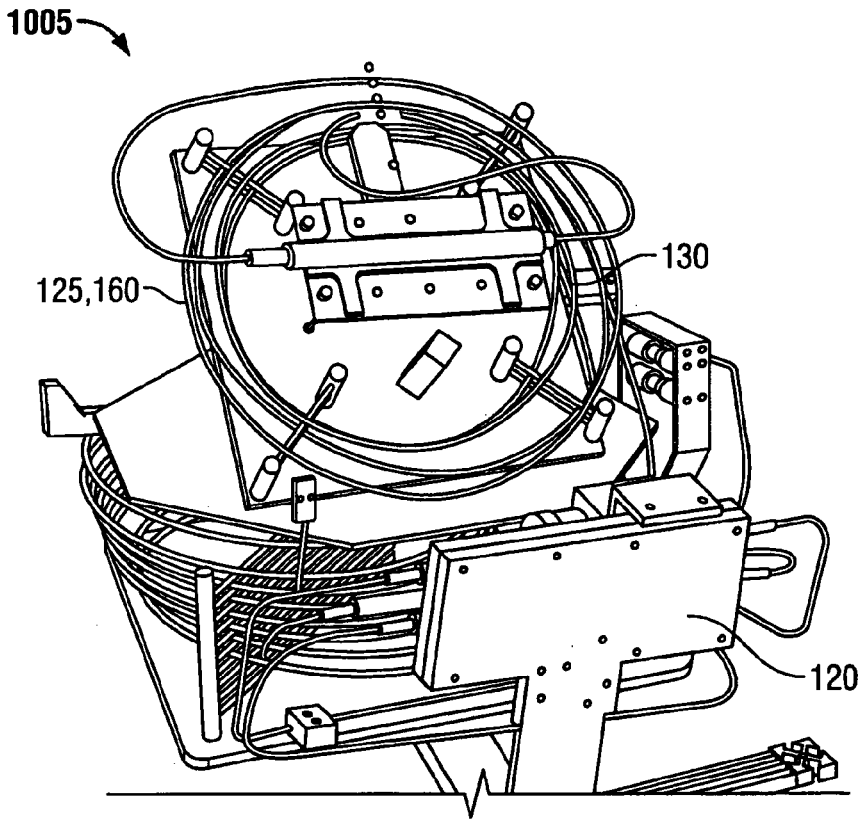
Figure 9C:
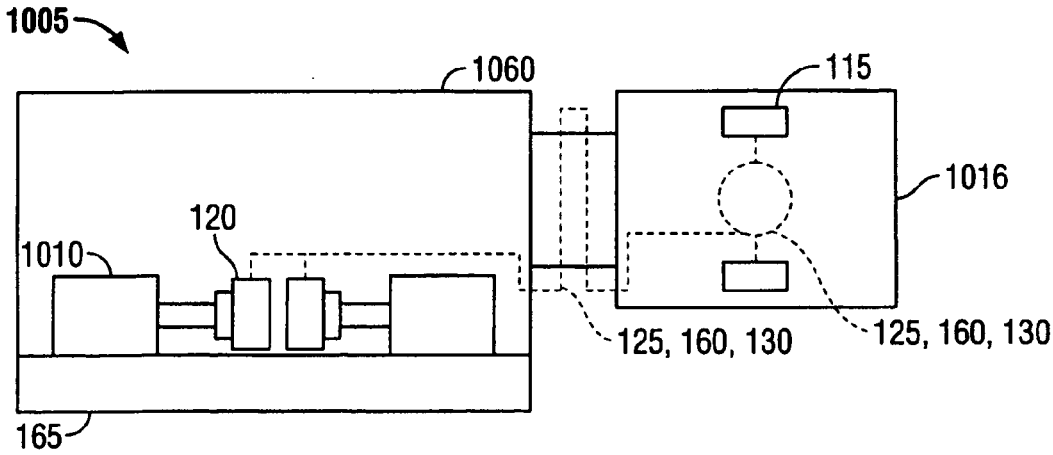

Referring to FIGS. 9A–9C, the heat transport system 100 may be implemented in an adjustable mounted or Gimbaled system 1005 in which the main evaporator 115 and a portion of the lines 125, 160, and 130 are mounted to rotate about an elevation axis 1020 within a range of ±45° and a portion of the lines 125, 160, and 130 are mounted to rotate about an azimuth axis 1025 within a range of ±220°. The lines 125, 160, 130 are formed from thin-walled tubing and are coiled around each axis of rotation. The system 1005 thermally couples a cryogenic component (or heat source that requires cryogenic cooling) 1016 such as a sensor of a cryogenic telescope to a cryogenic cooling source such as a cryocooler 1010 coupled to cool the condensers 120, 122. The cooling source 1010 is located at a stationary spacecraft 1060, thus reducing mass at the cryogenic telescope. Motor torque for controlling rotation of the lines 125, 160, 130, power requirements of the system 1005, control requirements for the spacecraft 1060, and pointing accuracy for the sensor 1016 are improved. The cryocooler 1010 and the radiator or heat sink 165 can be moved from the sensor 1016, reducing vibration within the sensor 1016. In one implementation, the system 1005 was tested to operate within the range of 70–115 K when the working fluid is nitrogen.

The heat transfer system 105 may be used in medical applications, or in applications where equipment must be cooled to below-ambient temperatures. As another example, the heat transfer system 105 may be used to cool an infrared (IR) sensor, which operates at cryogenic temperatures to reduce ambient noise. The heat transfer system 105 may be used to cool a vending machine, which often houses items that preferably are chilled to sub-ambient temperatures. The heat transfer system 105 may be used to cool components such as a display or a hard drive of a computer, such as a laptop computer, handheld computer, or a desktop computer. The heat transfer system 105 can be used to cool one or more components in a transportation device such as an automobile or an airplane.

Other implementations are within the scope of the following claims. For example, the condenser 120 and heat sink 165 can be designed as an integral system, such as, for example, a radiator. Similarly, the secondary condenser 122 and heat sink 165 can be formed from a radiator. The heat sink 165 can be a passive heat sink (such as a radiator) or a cryocooler that actively cools the condensers 120, 122.

In another implementation, the temperature of the reservoir 155 is controlled using a heater. In a further implementation, the reservoir 155 is heated using parasitic heat.

In another implementation, a coaxial ring of insulation is formed and placed between the liquid line 125 and the secondary fluid line 160, which surrounds the insulation ring.

What is claimed is:

1. A system comprising:

a heat transfer system including:

a main evaporator having a core, a primary wick, and a secondary wick, and a condenser coupled to the main evaporator by a liquid line and a vapor line, wherein a heat transfer system loop is defined by the main evaporator, the condenser, the liquid line, and the vapor line;

a priming system configured to convert fluid into a liquid capable of wetting the primary wick of the main evaporator, the priming system including:

a priming evaporator coupled to the vapor line, and a reservoir in fluid communication with the priming evaporator and coupled to the secondary wick of the main evaporator by a secondary fluid line.

2. The system of claim 1 wherein the reservoir is cold biased relative to an operating temperature of the heat transfer system.

3. The system of claim 2 wherein the reservoir is mounted to a heat sink thermally connected to the condenser.

4. The system of claim 1 wherein the secondary fluid line insulates the liquid line from parasitic heat input.

5. The system of claim 4 wherein the secondary fluid line is coaxial with and surrounds the liquid line.

6. The system of claim 1 wherein the priming system is configured to reduce the temperature of the heat transfer system.

7. The system of claim 1 wherein the main evaporator includes a three-port evaporator.

8. The system of claim 1 wherein the reservoir is coupled to the secondary wick of the main evaporator through a secondary condenser and a liquid line coupled to the core of the main evaporator.

9. The system of claim 1 wherein the priming system is configured to convert fluid that has a critical temperature above an operating temperature of the heat transfer system into a liquid.

10. The system of claim 9 wherein the operating temperature of the heat transfer system is a cryogenic temperature.

11. The system of claim 9 wherein the operating temperature of the heat transfer system is a sub-ambient temperature.

12. The system of claim 1 wherein the heat transfer system is used to cool an apparatus operating in an extra-terrestrial environment.

13. The system of claim 1 wherein the heat transfer system is used to cool an apparatus operating in a terrestrial environment.

14. The system of claim 1 wherein the heat transfer system is used to cool an electronic apparatus.

15. The system of claim 1 wherein the heat transfer system is used to cool an apparatus in a medical application.

16. The system of claim 1 wherein the heat transfer system is used to cool one or more of a vending machine, a computer, a component in a transportation device, a display for a computer, and an infrared sensor.

17. The system of claim 1 wherein the heat transfer system includes another reservoir operating at a temperature higher than the temperature of operation for the reservoir of the priming system to reduce a fill pressure of the system.

18. The system of claim 1 wherein the priming evaporator includes a core, a primary wick surround the core, and a secondary wick within the core.

19. The system of claim 1 wherein the main evaporator includes a bayonet tube extending through the core to guide fluid into the core.

20. A method of transporting heat, the method comprising:

priming a heat transfer system that includes a main evaporator, a vapor line, a condenser, and a liquid line connected in a loop, the priming including:

wetting a primary wick of a priming system evaporator, applying power to the priming system evaporator, converting fluid received from the priming system evaporator into a liquid, and wetting the main evaporator of the heat transfer system with the liquid through the liquid line; and reducing heat conditions within the heat transfer system, the reducing including at least one of sweeping vapor bubbles within the main evaporator into a reservoir in fluid communication with the priming evaporator or reducing parasitic heat gains on the liquid line.

21. The method of claim 20 wherein application of power to the priming evaporator enhances circulation of fluid within the heat transfer system.

22. The method of claim 21 wherein enhancing circulation of fluid within the heat transfer system includes enhancing circulation of fluid from the main evaporator, through the vapor line, through the condenser, through the liquid line, and returning into the main evaporator.

23. The method of claim 20 further comprising reducing power to the priming system evaporator once the priming system evaporator is wetted.

24. The method of claim 20 further comprising reducing power to the priming system evaporator once the priming system evaporator reaches a temperature below a critical temperature of the fluid.

25. The method of claim 20 further comprising cold biasing the reservoir relative to a temperature of the heat transfer system.

26. The method of claim 25 wherein cold biasing the reservoir includes mounting the reservoir to a heat sink that is in fluid communication with the condenser.

27. The method of claim 20 wherein wetting the primary wick of the priming system evaporator includes cold-biasing the reservoir to a temperature below the critical temperature of the fluid.

28. The method of claim 27 wherein wetting the primary wick of the priming system evaporator includes pumping liquid formed within the reservoir into the priming system evaporator using capillary pressure.

29. The method of claim 20 further comprising coupling the reservoir to a secondary fluid line in communication with a core of the main evaporator.

30. The method of claim 29 wherein sweeping vapor bubbles within the main evaporator into the reservoir includes sweeping bubbles through a secondary wick of the main evaporator, through a secondary fluid line, through a secondary condenser, and into the reservoir.

31. The method of claim 29 wherein reducing parasitic heat gains on the liquid line includes forming the secondary fluid line coaxially around the liquid line such that the secondary fluid line insulates the liquid line from parasitic heat gains.

32. The method of claim 29 wherein reducing parasitic heat gains on the liquid line includes sweeping vapor bubbles formed within the secondary fluid line due to the parasitic heat gains into the secondary condenser, where the vapor bubbles are cooled and pushed into the reservoir.

33. The method of claim 20 further comprising insulating the liquid line from parasitic heat gains.

34. The method of claim 20 further comprising operating the heat transfer system to transport heat from a heat source.

35. The method of claim 20 further comprising operating the heat transfer system at a cryogenic temperature.

36. The method of claim 20 further comprising operating the heat transfer system at a sub-ambient temperature.

37. The method of claim 20 further comprising using the heat transfer system to transport heat from an apparatus operating in an extra-terrestrial environment.

38. The method of claim 20 further comprising using the heat transfer system to transport heat from an apparatus operating in a terrestrial environment.

39. The method of claim 20 further comprising using the heat transfer system to transport heat from an electronic apparatus.

40. The method of claim 20 further comprising using the heat transfer system to transport heat from an apparatus within a medical device.

41. The method of claim 20 further comprising using the heat transfer system to transport heat from an infrared sensor.

42. The method of claim 20 further comprising using the heat transfer system to transport heat from a vending machine, a computer, a component in a transportation device, or a display device.

43. A system comprising:

a heat transfer system including:

a main evaporator having a core, a primary wick, and a secondary wick, and a main condenser coupled to the main evaporator by a liquid line and a vapor line, wherein a heat transfer system loop is defined by the main evaporator, the main condenser, the liquid line, and the vapor line; and a priming system configured to convert fluid into a liquid capable of wetting the primary wick of the main evaporator, the priming system including:

a priming evaporator coupled to the vapor line, a secondary condenser coupled to the priming evaporator and to a secondary fluid line that is in fluid communication with the core of the main evaporator, and a reservoir in fluid communication with the priming evaporator and coupled to the secondary wick of the main evaporator by the secondary fluid line and the secondary condenser;

wherein the priming system is configured to start the heat transfer system from a supercritical state and to purge vapor from the core of the primary evaporator.

44. A method of transporting heat, the method comprising:

priming a heat transfer system that includes a main evaporator, a vapor line, a condenser, and a liquid line connected in a loop, the priming including:

cold-biasing a reservoir to condense fluid, wetting a primary wick of a priming system evaporator including:

cold-biasing a reservoir coupled to the priming system evaporator to a temperature below the critical temperature of the fluid, and pumping liquid formed within the reservoir into the priming system evaporator using capillary pressure, applying power to the priming system evaporator to enhance circulation of fluid within the heat transfer system, converting fluid received from the priming system evaporator into a liquid, and wetting the main evaporator of the heat transfer system with the liquid through the liquid line;

supplying power to the priming system evaporator to reduce heat conditions within the heat transfer system by sweeping vapor bubbles within the main evaporator into the reservoir or reducing parasitic heat gains on the liquid line.

* * * * *

UNITED STATES PATENT AND TRADEMARK OFFICE

CERTIFICATE OF CORRECTION

PATENT NO. : 7,004,240 B1
APPLICATION NO. : 10/602022
DATED : February 28, 2006
INVENTOR(S) : Edward J. Kroliczek et al.

It is certified that error appears in the above-identified patent and that said Letters Patent is hereby corrected as shown below:

On the title page:

In ITEM (56) REFERENCES CITED, Other Publications

| | | |
|---|---|---|
| PAGE 2, | 1st column, | In the 5th entry, change "Bugby et al, Proceedings of teh" to --Bugby et al, Proceedings of the-- |
| PAGE 2, | 1st column, | In the 6th entry, change "Integration,"D." to --Integration," D.-- |
| PAGE 2, | 1st column, | In the 6th entry, change "Intermational conference; 31st," to --International conference; 31st-- |
| PAGE 2, | 1st column, | change "Pumped Loop,"Triem" to --Pumped Loop," Triem-- |
| PAGE 2, | 2nd column, | In the 10th entry, change ""Development of Advenced" to --"Development of Advanced"-- |
| PAGE 2, | 2nd column, | In the 3rd full entry of the 2nd column, change "Acondicionado Y Refreigeracion" to --Acondicionado Y Refrigeracion-- |
| PAGE 2, | 2nd column, | In the 4th full entry, change "Domestic Refrigerator,"Oguz, Emre" to --Domestic Refrigerator," Oguz, Emre-- |
| PAGE 2, | 2nd column, | In the 6th full entry, change "Macines for Domestic Refrigeration,"Berchowitz" to --Machines for Domestic Refrigeration," Berchowitz-- |
| PAGE 2, | 2nd column, | In the 7th full entry, change "Symposium by TTH Reserach" to --Symposium by TTH Research-- |
| PAGE 2, | 2nd column, | In the 11th full entry, change ""Multiple Evaporator Loop Heat Pipe,"James" to --"Multiple Evaporator Loop Heat Pipe," James-- |
| PAGE 2, | 2nd column, | In the 14th full entry, change ""Recent Advences in Capillary Pumped" to --"Recent Advances in Capillary Pumped-- |
| PAGE 2, | 2nd column, | In the 15th full entry, change ""Recent Advences in Stirling" to --"Recent Advances in Stirling-- |

Signed and Sealed this

Twentieth Day of July, 2010

David J. Kappos

David J. Kappos
*Director of the United States Patent and Trademark Office*

On the title page:

| | | |
|---|---|---|
| In ITEM (56) REFERENCES CITED, | | Other Publications (continued) |
| PAGE 3, | 1st column, | In the 1st entry, change ""Testing of a Caprillary Pumped" to --"Testing of a Capillary Pumped"-- |
| PAGE 3, | 1st column, | In the 3rd entry, change ""The Hybrid Capillary Pumped Loop,"J." to --"The Hybrid Capillary Pumped Loop," J.-- |
| PAGE 3, | 1st column, | In the 3rd entry, change "submitted to SAE 18th Ingersociety" to --submitted to SAE 18th Intersociety-- |
| PAGE 3, | 2nd column, | In the 2nd entry, change "Refrigeration,"Kim," to --Refrigeration," Kim,"-- |
| PAGE 3, | 2nd column, | In the 2nd entry, change "Congerence 32" to --Conference 32-- |

In the drawings:

| | | |
|---|---|---|
| In FIG. 1, | | insert --105-- and an associated lead line indicating an appropriate location of the heat transfer system |
| COLUMN 2, | LINE 28, | change "surround" to --surrounding-- |
| COLUMN 6, | LINE 44, | change "1, 15" to --115-- |
| COLUMN 7, | LINE 48, | change "outlet port 139" to --outlet 139-- |
| COLUMN 7, | LINE 52, | change "outlet port 139" to --outlet 139-- |
| COLUMN 7, | LINE 53, | change "outlet port 139" to --outlet 139-- |
| COLUMN 8, | LINE 8, | change "temperature 410" to --time 410-- |
| COLUMN 8, | LINE 60, | after "liquid" and before "flows" insert --522-- |
| COLUMN 8, | LINE 61, | after "fluid" insert --522-- |
| COLUMN 8, | LINE 63, | after "fluid" insert --522-- |
| COLUMN 8, | LINE 65, | after "fluid" insert --522-- |
| COLUMN 9, | LINE 65, | change "radiator" to --heat sink-- |
| COLUMN 10, | LINE 58, | change "of a" to --over a-- |
| COLUMN 11, | LINE 7, | after "1020" and before "within" insert --(not shown)-- |
| COLUMN 11, | LINE 9, | after "1025" and before "within" insert --(not shown)-- |
| COLUMN 11, | LINE 20, | at the end of the line, change "sensor" to --component-- |
| CLAIM 18, COLUMN 12, | LINE 52, | change "surround" to --surrounding-- |

UNITED STATES PATENT AND TRADEMARK OFFICE

CERTIFICATE OF CORRECTION

PATENT NO. : 7,004,240 B1
APPLICATION NO. : 10/602022
DATED : February 28, 2006
INVENTOR(S) : Edward J. Krolicek et al.

It is certified that error appears in the above-identified patent and that said Letters Patent is hereby corrected as shown below:

The title page showing an illustrative figure, should be deleted and substitute therefore the attached title page.

On the title page:

In ITEM (56) REFERENCES CITED, Other Publications

| | | |
|---|---|---|
| PAGE 2, | 1st column, | In the 5th entry, change "Bugby et al, Proceedings of teh" to --Bugby et al, Proceedings of the-- |
| PAGE 2, | 1st column, | In the 6th entry, change "Integration,"D." to --Integration," D.-- |
| PAGE 2, | 1st column, | In the 6th entry, change "International conference; 31st," to --International conference; 31st-- |
| PAGE 2, | 1st column, | change "Pumped Loop,"Triem" to --Pumped Loop," Triem-- |
| PAGE 2, | 2nd column, | In the 10th entry, change ""Development of Advenced" to --"Development of Advanced"-- |
| PAGE2, | 2nd column, | In the 3rd full entry of the 2nd column, change "Acondicionado Y Refreigeracion" to --Acondicionado Y Refrigeracion-- |
| PAGE 2, | 2nd column, | In the 4th full entry, change "Domestic Refrigerator,"Oguz, Emre" to --Domestic Refrigerator," Oguz, Emre-- |
| PAGE 2, | 2nd column, | In the 6th full entry, change "Macines for Domestic Refrigeration,"Berchowitz" to --Machines for Domestic Refrigeration," Berchowitz-- |
| PAGE 2, | 2nd column, | In the 7th full entry, change "Symposium by TTH Reserach" to --Symposium by TTH Research-- |
| PAGE 2, | 2nd column, | In the 11th full entry, change ""Multiple Evaporator Loop Heat Pipe,"James" to --"Multiple Evaporator Loop Heat Pipe," James-- |
| PAGE 2, | 2nd column, | In the 14th full entry, change ""Recent Advences in Capillary Pumped" to --"Recent Advances in Capillary Pumped-- |

Signed and Sealed this

Tenth Day of August, 2010

David J. Kappos

David J. Kappos
*Director of the United States Patent and Trademark Office*

On the title page:

| | | |
|---|---|---|
| In ITEM (56) REFERENCES CITED, | | Other Publications (continued) |
| PAGE 2, | 2nd column, | In the 15th full entry, change ""Recent Advences in Stirling" to --"Recent Advances in Stirling-- |
| PAGE 3, | 1st column, | In the 1st entry, change ""Testing of a Caprillary Pumped" to --"Testing of a Capillary Pumped"-- |
| PAGE 3, | 1st column, | In the 3rd entry, change ""The Hybrid Capillary Pumped Loop,"J." to --"The Hybrid Capillary Pumped Loop," J.-- |
| PAGE 3, | 1st column, | In the 3rd entry, change "submitted to SAE 18th Ingersociety" to --submitted to SAE 18th Intersociety-- |
| PAGE 3, | 2nd column, | In the 2nd entry, change "Refrigeration,"Kim," to --Refrigeration," Kim,"-- |
| PAGE 3, | 2nd column, | In the 2nd entry, change "Congerence 32" to --Conference 32-- |

In the drawings:

| | |
|---|---|
| In FIG. 1, | insert --105-- and an associated lead line indicating an appropriate location of the heat transfer system |

The sheet of drawings consisting of figure 1 should be deleted and substitute therefore the attached figure 1.

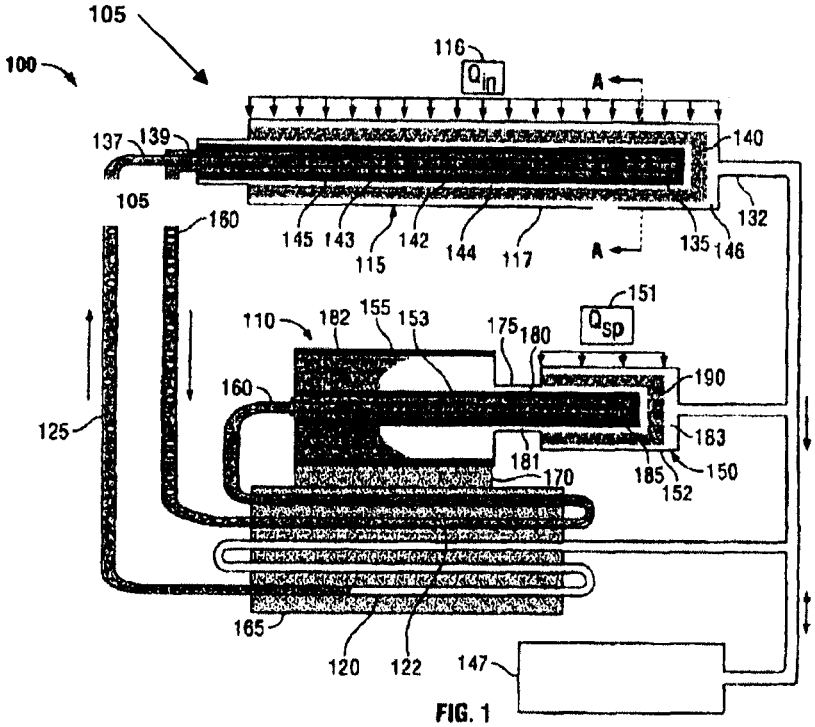

FIG. 1

| | | |
|---|---|---|
| COLUMN 2, | LINE 28, | change “surround” to --surrounding-- |
| COLUMN 6, | LINE 44, | change “1, 15” to --115-- |
| COLUMN 7, | LINE 48, | change “outlet port 139” to --outlet 139-- |
| COLUMN 7, | LINE 52, | change “outlet port 139” to --outlet 139-- |
| COLUMN 7, | LINE 53, | change “outlet port 139” to --outlet 139-- |
| COLUMN 8, | LINE 8, | change “temperature 410” to --time 410-- |
| COLUMN 8, | LINE 60, | after “liquid” and before “flows” insert --522-- |
| COLUMN 8, | LINE 61, | after “fluid” insert--522-- |
| COLUMN 8, | LINE 63, | after “fluid” insert --522-- |
| COLUMN 8, | LINE 65, | after “fluid” insert --522-- |
| COLUMN 9, | LINE 65, | change “radiator” to --heat sink-- |
| COLUMN 10, | LINE 58, | change “of a” to --over a-- |
| COLUMN 11, | LINE 7, | after “1020” and before “within” insert --(not shown)-- |
| COLUMN 11, | LINE 9, | after “1025” and before “within” insert --(not shown)-- |
| COLUMN 11, | LINE 20, | at the end of the line, change “sensor” to --component-- |

CLAIM 18, COLUMN 12, LINE 52, change “surround” to --surrounding--

(12) United States Patent
Kroliczek et al.

(10) Patent No.: US 7,004,240 B1
(45) Date of Patent: Feb. 28, 2006

(54) HEAT TRANSPORT SYSTEM

(75) Inventors: Edward J. Kroliczek, Davidsonville, MD (US); James Seokgeun Yun, Silver Spring, MD (US)

(73) Assignee: Swales & Associates, Inc., Beltsville, MD (US)

( * ) Notice: Subject to any disclaimer, the term of this patent is extended or adjusted under 35 U.S.C. 154(b) by 269 days.

(21) Appl. No.: 10/602,022

(22) Filed: Jun. 24, 2003

Related U.S. Application Data

(60) Provisional application No. 60/391,006, filed on Jun. 24, 2002.

(51) Int. Cl.
*F28D 15/00* (2006.01)

(52) U.S. Cl. ..... 165/104.26; 165/41; 165/42; 165/104.21; 165/104.33; 165/104.11; 165/104.19

(58) Field of Classification Search ..... 165/41, 165/42, 104.21, 104.26, 104.33, 104.11, 104.19; 244/163, 158 R
See application file for complete search history.

(56) References Cited

U.S. PATENT DOCUMENTS

| | | | | |
|---|---|---|---|---|
| 4,862,708 | A | 9/1989 | Basiulis | |
| 5,103,897 | A * | 4/1992 | Cullimore et al. | 165/274 |
| 5,303,768 | A * | 4/1994 | Alario et al. | 165/104.26 |
| 5,771,967 | A | 6/1998 | Hyman | |
| 5,816,313 | A | 10/1998 | Baker | |
| 5,842,513 | A * | 12/1998 | Maciaszek et al. | 165/104.26 |
| 5,899,265 | A * | 5/1999 | Schneider et al. | 165/104.33 |
| 5,944,092 | A * | 8/1999 | Van Oost | 165/104.26 |
| 5,950,710 | A | 9/1999 | Liu | |
| 5,966,957 | A * | 10/1999 | Malhammar et al. | 62/259.2 |
| 6,058,711 | A * | 5/2000 | Maciaszek et al. | 62/3.2 |
| 6,330,907 | B1 * | 12/2001 | Ogushi et al. | 165/104.26 |
| 6,381,135 | B1 * | 4/2002 | Prasher et al. | 361/700 |
| 6,382,309 | B1 | 5/2002 | Kroliczek et al. | |
| 6,450,132 | B1 * | 9/2002 | Yao et al. | 122/366 |
| 6,615,912 | B1 * | 9/2003 | Garner | 165/104.26 |
| 6,810,946 | B1 | 11/2004 | Hoang | |
| 6,889,754 | B1 | 5/2005 | Kroliczek et al. | |
| 2002/0007937 | A1 * | 1/2002 | Kroliczek et al. | 165/104.26 |
| 2003/0051857 | A1 * | 3/2003 | Cluzet et al. | 165/41 |

(Continued)

FOREIGN PATENT DOCUMENTS

| | | |
|---|---|---|
| EP | 0 210 337 | 2/1987 |

(Continued)

OTHER PUBLICATIONS

"A high power spacecraft thermal management system," J. Ku, et al., AIAA-1988-2702, Thermophysics, Plasmadynamics and Lasers Conference, San Antonio, TX, Jun. 27-29, 1988, 12 pages.

(Continued)

*Primary Examiner*—Henry Bennett
*Assistant Examiner*—Nihir Patel
(74) *Attorney, Agent, or Firm*—Fish & Richardson P.C.

(57) ABSTRACT

A system includes a heat transfer system and a priming system coupled to the heat transfer system. The heat transfer system includes a main evaporator having a core, a primary wick, and a secondary wick, and a condenser coupled to the main evaporator by a liquid line and a vapor line. A heat transfer system loop is defined by the main evaporator, the condenser, the liquid line, and the vapor line. The priming system is configured to convert fluid into a liquid capable of wetting the primary wick of the main evaporator. The priming system includes a priming evaporator coupled to the vapor line, and a reservoir in fluid communication with the priming evaporator and coupled to the secondary wick of the main evaporator by a secondary fluid line.

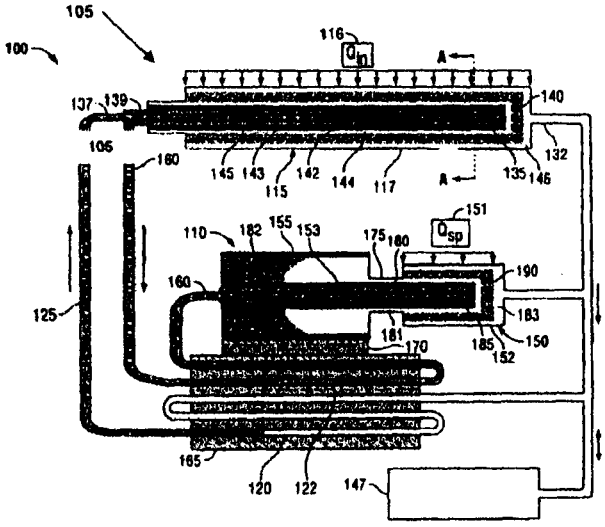

44 Claims, 10 Drawing Sheets